US010233743B2

(12) United States Patent
Morgan-Smith et al.

(10) Patent No.: US 10,233,743 B2
(45) **Date of Patent: *Mar. 19, 2019**

(54) EXTENDABLE ORIENTING TOOL FOR USE IN WELLS

(71) Applicant: Halliburton Energy Services, Inc., Houston, TX (US)

(72) Inventors: Jonathan Morgan-Smith, Hundvag (NO); Neil Hepburn, Newcastle Upon Tyne (GB)

(73) Assignee: Halliburton Energy Services, Inc., Houston, TX (US)

( * ) Notice: Subject to any disclaimer, the term of this patent is extended or adjusted under 35 U.S.C. 154(b) by 167 days.

This patent is subject to a terminal disclaimer.

(21) Appl. No.: 15/286,979

(22) Filed: Oct. 6, 2016

(65) Prior Publication Data

US 2017/0022801 A1 Jan. 26, 2017

Related U.S. Application Data

(63) Continuation of application No. 14/085,674, filed on Nov. 20, 2013, now Pat. No. 9,500,071, which is a (Continued)

(51) Int. Cl.
*E21B 47/024* (2006.01)
*E21B 43/12* (2006.01)
(Continued)

(52) U.S. Cl.
CPC ..... *E21B 47/024* (2013.01); *E21B 43/12* (2013.01); *E21B 47/12* (2013.01); *E21B 7/061* (2013.01);
(Continued)

(58) Field of Classification Search
CPC ..... E21B 47/00; E21B 47/024
See application file for complete search history.

(56) References Cited

U.S. PATENT DOCUMENTS 3,893,948 A 7/1975 Khcheyan et al.
4,351,116 A 9/1982 Scott, Jr.
(Continued)

FOREIGN PATENT DOCUMENTS

WO 2011004180 A2 1/2011

OTHER PUBLICATIONS

Halliburton FlexRite Multilateral System, "Basic Operational Sequence," product brochure, undated 11 pages.
(Continued)

*Primary Examiner* — Brad Harcourt
(74) *Attorney, Agent, or Firm* — Chamberlain Hrdlicka

(57) ABSTRACT

An orienting tool for use in wells can include a flow control device which controls flow between an interior and an exterior of a body of the tool to thereby transmit a signal indicative of an orientation of the body, the flow control device being outwardly extendable relative to the body. A method of orienting a structure in a well can include transmitting at least one signal from an orienting tool, the signal being indicative of an orientation of the orienting tool, and displacing a housing of the tool outward relative to a generally tubular body of the tool. A well system can include an orienting tool connected to a structure and positioned in a wellbore, the tool including a housing which is outwardly extendable relative to a generally tubular body, the tool being configured to transmit at least one signal indicative of an orientation of the structure.

13 Claims, 3 Drawing Sheets

Related U.S. Application Data continuation of application No. PCT/US2012/067604, filed on Dec. 3, 2012.

(51) Int. Cl.

| | |
|---|---|
| ***E21B 47/12*** | (2012.01) |
| *E21B 7/06* | (2006.01) |
| *E21B 33/12* | (2006.01) |
| *E21B 34/06* | (2006.01) |
| *E21B 43/08* | (2006.01) |
| *E21B 43/116* | (2006.01) |
| *E21B 47/06* | (2012.01) |
| *E21B 47/14* | (2006.01) |

(52) U.S. Cl.

CPC ..... *E21B 33/12* (2013.01); *E21B 34/06* (2013.01); *E21B 43/08* (2013.01); *E21B 43/116* (2013.01); *E21B 47/06* (2013.01); *E21B 47/122* (2013.01); *E21B 47/14* (2013.01)

(56) References Cited

U.S. PATENT DOCUMENTS

| | | | | |
|---|---|---|---|---|
| 4,771,408 | A | 9/1988 | Kotlyar | |
| 4,852,262 | A | 8/1989 | Babcock et al. | |
| 5,421,420 | A | 6/1995 | Malone | |
| 5,829,520 | A | 11/1998 | Johnson | |
| 6,026,915 | A | 2/2000 | Smith et al. | |
| 6,588,116 | B2 | 7/2003 | Dallas et al. | |
| 8,091,246 | B2 | 1/2012 | Hepburn | |
| 9,500,071 | B2 * | 11/2016 | Morgan-Smith ..... | E21B 47/024 |
| 2001/0052428 | A1 | 12/2001 | Larronde | |
| 2004/0118611 | A1 * | 6/2004 | Runia ..... | E21B 4/02 175/57 |
| 2010/0175923 | A1 | 7/2010 | Allan | |
| 2012/0106297 | A1 | 5/2012 | Fraser | |

OTHER PUBLICATIONS

Sperry-Sun Drilling Services, "Reporting on the Casing Orientation System," product brochure, undated 2 pages.

Intelligent Well Controls LTD, "Intelligent Tools for the Oil & Gas Industry," product brochure, 2011, 2 pages.

Office Action dated Mar. 17, 2010 for U.S. Appl. No. 12/027,460, 12 pages.

Office Action dated Sep. 16, 2010 for U.S. Appl. No. 12/027,460, 10 pages.

Office Action dated Dec. 27, 2010 for U.S. Appl. No. 12/027,460, 11 pages.

Office Action dated Jun. 9, 2011 for U.S. Appl. No. 12/027,460, 13 pages.

* cited by examiner

EXTENDABLE ORIENTING TOOL FOR USE IN WELLS

BACKGROUND

This disclosure relates generally to equipment utilized and operations performed in conjunction with subterranean wells and, in one example described below, more particularly provides an extendable orienting tool for use in wells.

Space in a wellbore is generally very limited, and so it is desirable to efficiently utilize space in a wellbore. Unfortunately, present orienting tools used to orient structures in wells can take up substantial space and, thus, can limit applicability of the orienting tools.

It will, therefore, be readily appreciated that improvements are continually needed in the arts of constructing and utilizing orienting tools.

DETAILED DESCRIPTION

Figure 1:
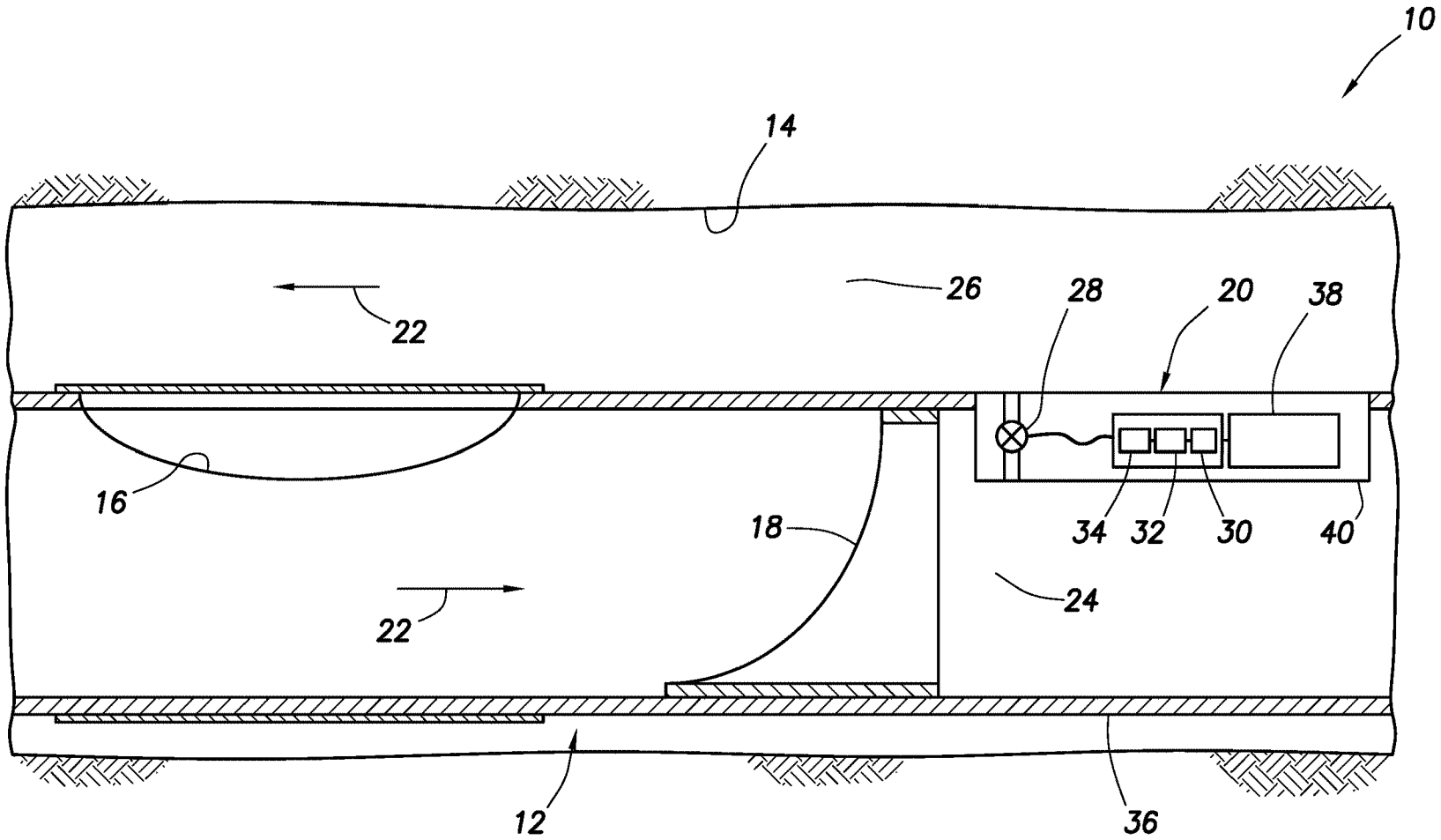
FIG. 1 is a representative partially cross-sectional view of a well system and associated method which can embody principles of this disclosure.

Representatively illustrated in FIG. 1 is an orienting system 10 for use with a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is positioned in a wellbore 14. The tubular string 12 is depicted in FIG. 1 as comprising casing, but other types of tubular strings (such as, liner, tubing, screen, etc.) may be used in other examples.

The wellbore 14 is depicted in FIG. 1 as being generally horizontal and open hole or uncased, but in other examples the wellbore could be generally vertical or inclined, lined with casing, liner, cement, etc. Thus, the scope of this disclosure is not limited to the details of the tubular string 12 and the wellbore 14 as depicted in the drawings or described herein.

The tubular string 12 includes certain structures for which it is desired to indicate an orientation in the wellbore 14. These structures include a window 16 and an orienting profile 18, in the FIG. 1 example. However, it should be clearly understood that any type of structure may be oriented in a wellbore using the principles described in this disclosure. Other types of structures which could be oriented include, for example, a latch coupling for orienting and anchoring a diverter or whipstock, a perforating gun, a diverter or whipstock, etc. Thus, the scope of this disclosure is not limited to orienting any particular type of structure in a wellbore.

An orienting tool 20 is also connected in the tubular string 12. The orienting tool 20 indicates an azimuthal orientation of the window 16 and profile 18 relative to the wellbore 14 and gravity by selectively controlling fluid 22 flow between an interior and an exterior of the tool while the fluid is circulated through the tubular string 12.

In the FIG. 1 example, the fluid 22 flows through an interior flow passage 24 extending longitudinally through the tubular string 12. The fluid 22 exits a distal end (not shown) of the tubular string 12 and returns through an annulus 26 formed between the tubular string and the wellbore 14.

By selectively opening and closing (or decreasing and increasing flow through) a flow control device 28 of the tool 20, pressure signals can be transmitted to the earth's surface or another remote location having a pressure sensor to detect pressure in the flow passage 24. For example, when the flow control device 28 opens a pressure decrease is caused in the flow passage 24, and when the flow control device closes a pressure increase is caused in the flow passage.

These pressure manipulations can be used to transmit signals indicative of the orientation in the wellbore 14 of the tool 20, and of structures to which the tool is connected (such as, the window 16 and profile 18, etc.). Suitable techniques for transmitting such signals are described in US Publication No. 2012/0106297, although the scope of this disclosure is not limited to those techniques.

For sensing an orientation of the tool 20 and connected structures in the well, the tool includes an orientation sensor 30 (such as, an accelerometer, a gyroscope, etc.), a processor 32 and memory 34. The processor 32 may be programmed to actuate the flow control device 28 in a particular manner (opened, closed, opening and closing at a predetermined rate, a specific pattern of openings and/or closings, etc.) when the orientation sensor 30 indicates that the tool 20 and connected structures are oriented as desired, or are not oriented as desired. Thus, the scope of this disclosure is not limited to any particular technique for transmitting orientation indicating signals to a remote location using the flow control device 28.

The flow control device 28 may comprise a valve or choke capable of regulating flow between the interior and exterior of a generally tubular body 36 of the tool 20. The flow control device 28, sensor 30, processor 32, memory 34 and batteries 38 may be mounted in a housing 40 that is outwardly extendable through a wall of the body 36.

Note that it is not necessary for all of the flow control device 28, sensor 30, processor 32, memory 34 and batteries 38 to be contained in the housing 40, or for any of these components to be contained in a housing at all. Thus, the scope of this disclosure is not limited to any particular arrangement or combination of components in the tool 20.

As depicted in FIG. 1, the housing 40 is retracted into the body 36. This configuration allows the tool 20 to be displaced through casing strings and other restrictions when the tubular string 12 is being installed in the wellbore 14. After a reduced outer dimension of the tool 20 is no longer needed, the housing 40 can be extended outward from the body 36, as representatively illustrated in FIG. 2.

Figure 2:
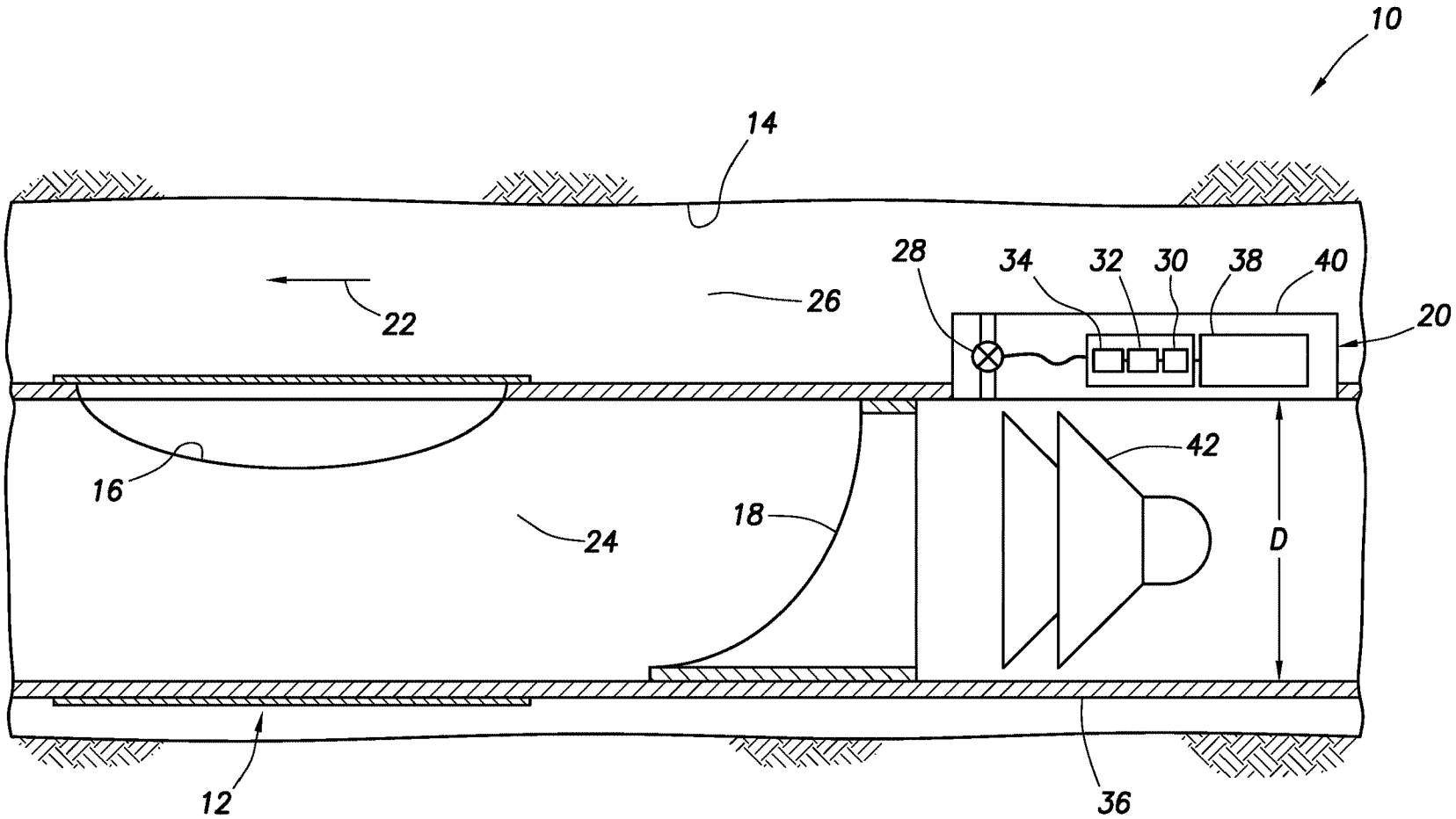
FIG. 2 is a representative cross-sectional view of the well system and method, wherein an orienting tool has been extended outward.

In the FIG. 2 configuration, an interior dimension D of the tool 20 is increased, due to the outward extension of the housing 40. This increased interior dimension D allows for displacement of fluids (such as, cement, stimulation fluids, etc.) and objects (such as, a cementing dart 42, other types of tools, etc.) through the passage 24 with less restriction.

The housing 40 may be displaced outward at any desired point in an orienting procedure. For example, the housing 40 may be displaced outward either before or after the tool 20 is oriented as desired in the wellbore 14, before or after the orientation indicating signals are transmitted by the flow control device 28, etc.

In one example, the housing 40 may be extended outwardly in response to an object (e.g., the dart 42, a plug, a ball, a probe, etc.) displacing through the body 36 and biasing the housing 40 outward. For example, the dart 42 could apply an outwardly biasing force to the housing 40 when the dart is pumped through the body 36 to initiate a cementing operation.

Figure 4:
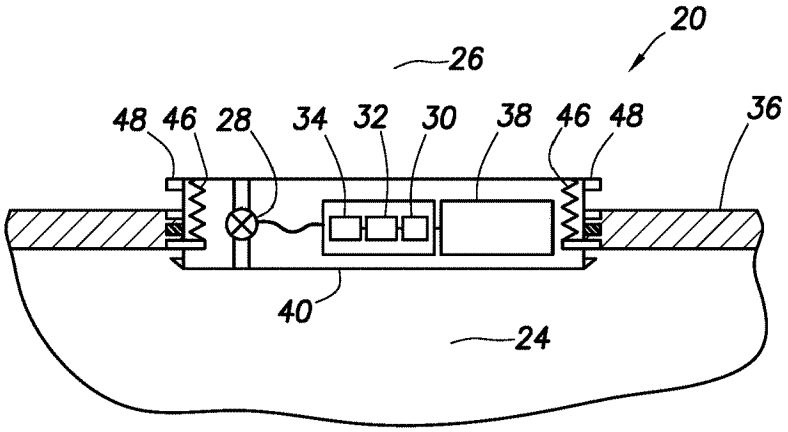
FIGS. 4-6 are representative cross-sectional views of additional examples of the orienting tool.
Figure 3:
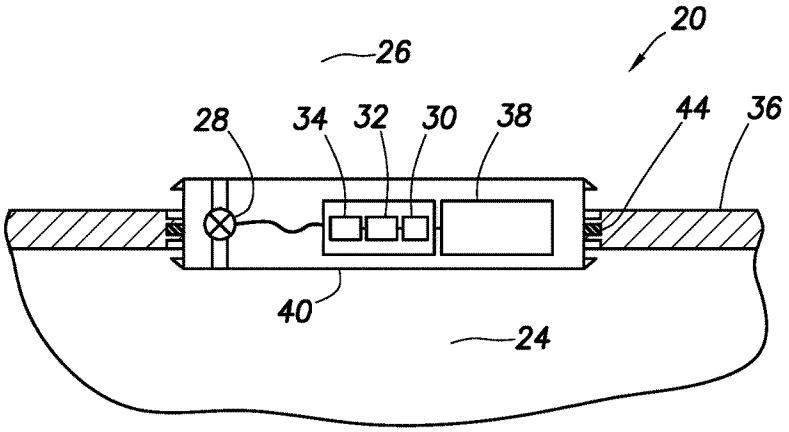
FIG. 3 is a representative cross-sectional view of one example of the orienting tool.
Figure 5:
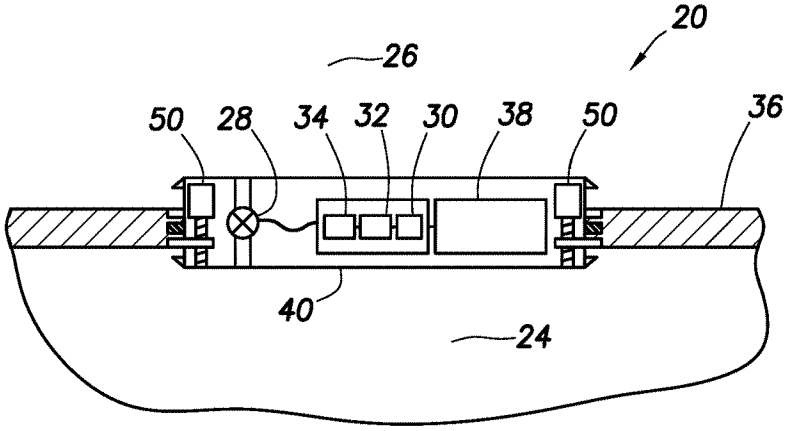

Representatively illustrated in FIGS. 3-5 are additional examples of techniques for extending the housing 40 outward. However, it should be understood that these are merely examples of a wide variety of different techniques for displacing the housing 40, and the scope of this disclosure is not limited to use of any particular displacement technique.

In the FIG. 3 example, a seal 44 is provided between the housing 40 and the body 36, so that a pressure differential can be applied across the housing between the interior and the exterior of the body 36. When a predetermined pressure differential is applied (for example, after landing a plug or cementing dart 42 below), the housing 40 displaces outward through the wall of the body 36. The predetermined pressure differential could be set, for example, by shear pins, other types of shear members, a pressure operated latch, etc. FIG. 3 depicts the housing 40 midway between its retracted and extended configurations.

In the FIG. 4 example, biasing devices 46 (such as, springs, compressed gas chambers, etc.) apply outwardly biasing forces to the housing 40. The housing 40 may be released for displacement in response to the biasing forces by latches 48. The latches 48 may be controlled by the processor 32.

In the FIG. 5 example, motors 50 (such as, electrical motors, hydraulic motors, etc.) displace the housing 40 outward. For example, the motors 50 could rotate threaded rods which engage internally threaded components attached to the body 36. Other types of drive mechanisms may be used, as desired.

Figure 6:
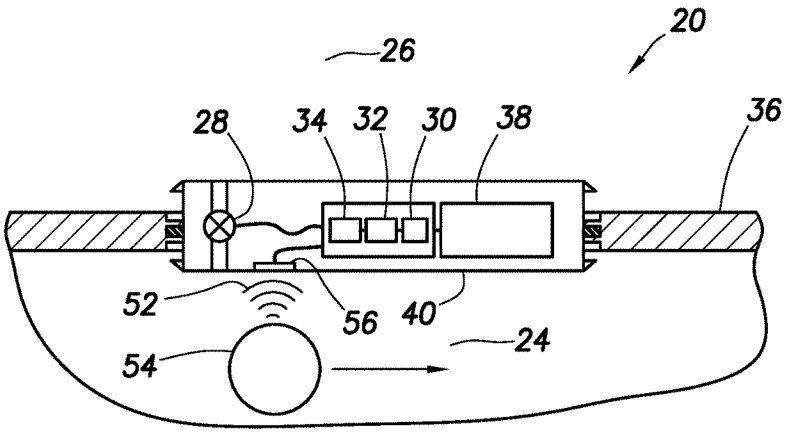

Representatively illustrated in FIG. 6 is a cross-sectional view of yet another example of the orienting tool 20. In this example, the housing 40 is extended outward in response to a signal 52 (for example, an electromagnetic or acoustic signal, etc.) transmitted from an object 54 (such as, a ball, dart, plug, etc.) which is displaced (e.g., flowed, dropped, conveyed, etc.) through the passage 24. For example, the object 54 could transmit a radio frequency identification (RFID, e.g., passive and active tagging device technology) signal to the orienting tool 20.

The tool 20 includes a receiver or sensor 56 which detects the signal 52. The processor 32 may release the latches 48 in the FIGS. 3, 4 & 6 examples, activate the motors 50 in the FIG. 5 example, or otherwise allow the housing 40 to be outwardly extended, in response to receipt of an appropriate signal 52 from the object 54.

Alternatively, the object 54 may not be used, and the sensor 56 may detect pressure in the passage 24 as manipulated from a remote location. For example, the sensor 56 could comprise a pressure sensor which detects pressure in the passage 24. A particular level and/or pattern of pressure increases and/or decreases may be used as a signal to cause the housing 40 to extend outwardly.

Any manner of transmitting a signal to the tool 20 to cause the housing 40 to extend outwardly may be used in keeping with the scope of this disclosure. For example, the signal may be transmitted wirelessly (e.g., by electromagnetic, acoustic, pressure pulse, etc., telemetry) or by use of electric, hydraulic, optical, etc., conductors (e.g., interior to, exterior to, and/or in a wall of the tubular string 12).

When the signal to extend the housing 40 outwardly has been received, the tool 20 can confirm receipt of the signal by transmitting a confirmation signal back to the remote location, such as, by using the flow control device 28 to selectively control flow between the interior and exterior of the body 36, as described above. When the housing 40 has been extended fully outward, the tool 20 can transmit a signal to the remote location indicating that the tool is in its extended configuration.

In other examples, the housing 40 could be extended by driving it outward with a drift (e.g., conical or otherwise shaped) displaced through the passage 24. Thus, the scope of this disclosure is not limited to any particular technique used for extending the housing 40 outward.

Once the housing 40 has been extended outward, it may be locked in that position. In this manner, the passage 24 will not subsequently be restricted by the presence of the housing 40 therein. Any manner of locking the housing 40 in its outwardly extended position may be used, in keeping with the scope of this disclosure.

It may now be fully appreciated that the above disclosure provides significant advancements to the art of constructing and operating orienting tools. In examples described above, the housing 40 (with or without the flow control device 28, orientation sensor 30, etc. therein) can be retracted while the tool 20 is installed in a well, and then the housing can be extended outward, in order to increase the interior dimension D in the body 36 of the tool, thereby decreasing a restriction in the tool.

An orienting tool 20 for use in wells is provided to the art by the above disclosure. In one example, the orienting tool 20 can include a flow control device 28 which controls flow between an interior and an exterior of a body 36 of the orienting tool 20 to thereby transmit at least one signal indicative of an orientation of the body 36. The flow control device 28 is outwardly extendable relative to the body 36.

The body 36 may be generally tubular shaped. The flow control device 28 may be contained in a housing 40 which extends outwardly through a wall of the body 36.

The outward extension of the flow control device 28 can increase an interior dimension D in the body 36.

The flow control device 28 may extend outwardly in response to a biasing force applied by an object (such as the dart 42) which displaces in the body 36, in response to application of a predetermined pressure to an interior of the body 36, in response to application of a predetermined pressure pattern to the tool 20, in response to application of a predetermined pressure differential to the tool 20, in response to a signal 52 transmitted by an object 54 which displaces in the body 36, or in response to transmission of a predetermined signal to the tool 20.

The orienting tool 20 may include a sensor 56 which receives a signal 52 transmitted by an object 54 in the body 36.

The orienting tool 20 may include a motor 50 and/or a biasing device 46 which displaces the flow control device 28.

A method of orienting a structure (such as, the window 16, the orienting profile 18, etc.) in a subterranean well is also described above. In one example, the method can comprise transmitting at least one signal from an orienting tool 20, the signal being indicative of an orientation of the orienting tool 20 in the well; and displacing a housing 40 of the orienting tool 20 outward relative to a generally tubular body 36 of the orienting tool 20.

The method can include connecting the orienting tool 20 at a known orientation relative to the structure, and positioning the structure and the orienting tool 20 in the well.

The step of displacing the housing 40 may be performed after the step of positioning the structure and the tool 20 in the well.

The transmitting step can include a flow control device 28 controlling flow between an interior and an exterior of the body 36 to thereby transmit the signal.

The flow control device 28 may be contained in the housing 40.

The displacing step can include increasing an interior dimension D in the body 36.

The displacing step may be performed in response to a biasing force applied by an object which displaces in the body 36, in response to application of a predetermined pressure to an interior of the body 36, in response to application of a predetermined pressure pattern to the tool 20, in response to application of a predetermined pressure pattern to the tool 20, in response to transmission of a signal by an object 54 which displaces in the body 36, or in response to application of a predetermined pressure differential to the tool 20.

A well system 10 is also described above. In one example, the well system can include an orienting tool 20 connected to a structure (e.g., the window 16, the orienting profile 18, etc.) and positioned in a wellbore 14, the orienting tool 20 including a housing 40 which is outwardly extendable relative to a generally tubular body 36, the orienting tool 20 being configured to transmit at least one signal indicative of an orientation of the structure.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well system, comprising:

an orienting tool connected to a tubular string, the orienting tool comprises:

a housing which is outwardly extendable relative to the tubular string; and a flow control device operable to control a flow between an interior and an exterior of the tubular string to transmit at least one signal indicative of an orientation of the tubular string.

2. The well system of claim 1, further comprising the tubular string.

3. The well system of claim 2, wherein the flow control device is contained in the housing.

4. The well system of claim 1, wherein outward extension of the housing increases an interior dimension in the tubular string.

5. The well system of claim 1, wherein the housing extends outwardly in response to a biasing force applied by an object which displaces in the tubular string.

6. The well system of claim 1, wherein the housing extends outwardly in response to application of a predetermined pressure to an interior of the tubular string.

7. The well system of claim 1, wherein the housing extends outwardly in response to application of a predetermined pressure pattern to the tool.

8. The well system of claim 1, wherein the housing extends outwardly in response to application of a predetermined pressure differential to the tool.

9. The well system of claim 1, wherein the housing extends outwardly in response to a signal transmitted by an object which displaces in the tubular string.

10. The well system of claim 1, wherein the housing extends outwardly in response to transmission of a predetermined signal from a remote location to the tool.

11. The well system of claim 1, wherein the orienting device further includes a sensor which receives a signal transmitted by an object in the tubular string.

12. The well system of claim 1, wherein the orienting tool further includes a motor which displaces the housing.

13. The well system of claim 1, wherein the orienting tool further includes a biasing device which displaces the housing.

* * * * *